US009297167B1

(12) United States Patent
Stockton

(10) Patent No.: US 9,297,167 B1
(45) Date of Patent: Mar. 29, 2016

(54) PREFABRICATED TILE WALL

(71) Applicant: Baymont, Inc., Golden, MS (US)

(72) Inventor: Mike Stockton, Golden, MS (US)

(73) Assignee: Baymont, Inc., Golden, MS (US)

( * ) Notice: Subject to any disclaimer, the term of this patent is extended or adjusted under 35 U.S.C. 154(b) by 0 days.

(21) Appl. No.: 14/608,037

(22) Filed: Jan. 28, 2015

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04F 13/08*** | (2006.01) |
| ***E04F 13/14*** | (2006.01) |
| *E04F 13/16* | (2006.01) |
| *E04F 15/02* | (2006.01) |
| *A47K 4/00* | (2006.01) |
| *E04B 1/348* | (2006.01) |

(52) U.S. Cl.
CPC ..... *E04F 13/0862* (2013.01); *E04F 13/0885* (2013.01); *E04F 13/142* (2013.01); *A47K 4/00* (2013.01); *E04B 1/34869* (2013.01); *E04F 13/0801* (2013.01); *E04F 13/165* (2013.01); *E04F 15/02188* (2013.01)

(58) Field of Classification Search
CPC ..... E04F 13/165; E04F 15/02188; E04F 13/0801; A47K 4/00; E04B 1/34869
USPC ..... 52/35, 745.13, 749.11, 747.11, 742.16, 52/742.15, 36.1; 4/596, 663
See application file for complete search history.

(56) References Cited

U.S. PATENT DOCUMENTS

| | | | | |
|---|---|---|---|---|
| 3,239,981 | A | 3/1966 | Fitzgerald | |
| 3,421,277 | A | 1/1969 | Frischmuth | |
| 3,444,660 | A | 5/1969 | Feichter et al. | |
| 4,324,605 | A * | 4/1982 | Bethea | A47K 3/001 156/247 |
| 4,522,855 | A * | 6/1985 | Bethea | A47K 3/001 156/71 |
| 4,832,995 | A | 5/1989 | McLauchlin | |
| 5,816,005 | A | 10/1998 | Han | |
| 6,098,354 | A | 8/2000 | Skandis | |
| 6,330,774 | B1 | 12/2001 | Weinstein | |
| 8,001,744 | B1 * | 8/2011 | Squitieri | C08L 63/00 427/284 |
| 2007/0294954 | A1 | 12/2007 | Barrett et al. | |
| 2010/0071125 | A1 * | 3/2010 | Miller | A47K 3/40 4/613 |
| 2010/0186333 | A1 | 7/2010 | Miller | |
| 2012/0017528 | A1 * | 1/2012 | Liu | E04F 13/0862 52/309.1 |
| 2013/0097944 | A1 * | 4/2013 | Van Ravenhorst | E04F 13/165 52/35 |
| 2014/0053487 | A1 | 2/2014 | Tatari | |
| 2014/0331598 | A1 * | 11/2014 | White | E04F 13/09 52/775 |

* cited by examiner

*Primary Examiner* — Chi Q Nguyen
(74) *Attorney, Agent, or Firm* — Gardere Wynne Sewell LLP

(57) ABSTRACT

A method of constructing a tile bathroom includes providing a prefabricated wall, wherein the prefabricated wall includes a planar substrate and a plurality of ceramic tiles secured to the planar substrate. The prefabricated wall includes at least one opening positioned between the plurality of tiles. The method also includes placing the planar substrate adjacent to a wall of a building and placing a fastening mechanism in the at least one opening to secure the prefabricated wall to the wall of the building. The method also includes covering the fastening mechanism and the at least one opening with an epoxy grout.

20 Claims, 5 Drawing Sheets

PREFABRICATED TILE WALL

TECHNICAL FIELD

The present invention relates generally to tile walls, and, more particularly, to a prefabricated tile wall for use in the construction of a bathroom, kitchen, laundry room or other room of a building.

BACKGROUND

Bathrooms, kitchens, laundry rooms, and other similar locations in a building often include tile surfaces. The tile surfaces are beneficial for use in these locations due to the aesthetically pleasing appearance of the tile, the generally water-resistant outer surface of the tiles and the ease of cleaning the tile surfaces.

Recently, consumers of mobile homes and homes with prefabricated elements, such as speculation homes (also called a "spec homes"), have desired the benefits of tile surfaces. This has led builders to attempt to incorporate tile surfaces into spec homes and mobile homes. However, builders have encountered problems using tile in these environments, such as construction delays while waiting for the tile surfaces to cure at the building site. In other instances, the pre-constructed tile surfaces have been damaged while being transported to the building site or upon installation at the building site. It would be beneficial to have a prefabricated tile wall for use in constructing bathrooms and other similar rooms that is easy to install and is resistant to damage during transportation and installation.

SUMMARY

In a first aspect, there is provided a method of constructing a tile bathroom that includes providing a prefabricated wall, wherein the prefabricated wall includes a planar substrate and a plurality of ceramic tiles secured to the planar substrate. In some embodiments, the prefabricated wall includes at least one opening positioned between the plurality of tiles. The method also includes placing the planar substrate adjacent to a wall of a building and placing a fastening mechanism in the opening to secure the prefabricated wall to the wall of the building. The method also includes covering the fastening mechanism and the at least one opening with an epoxy grout.

In some embodiments, the prefabricated wall includes tile grout between the plurality of tiles.

In other embodiments, a color of the tile grout matches a color of the epoxy grout.

In yet other embodiments, the at least one opening is located at least partially within the tile grout.

In still other embodiments, providing a prefabricated wall includes heating the planar substrate, the plurality of tiles and the tile grout to cure the tile grout.

In additional embodiments, placing a fastening mechanism in the at least one opening to secure the prefabricated wall to the wall of the building includes screwing the fastening mechanism into the wall of the building.

In further embodiments, the method includes placing an adhesive between the prefabricated wall to the wall of the building.

In other embodiments, the tile grout is rapid set grout.

In a second aspect, there is provided a method of constructing a tile wall for a bathroom that includes providing a planar substrate and providing a plurality of ceramic tiles. The method also includes placing an adhesive between the planar substrate and the plurality of ceramic tiles and placing a tile grout between the plurality of ceramic tiles. The method then includes heating the planar substrate and the plurality of ceramic tiles until the adhesive is at least partially cured. The method also includes creating at least one opening in the tile grout.

In some embodiments, the method includes creating a plurality of openings located at least partially within the tile grout.

In other embodiments, creating the at least one opening includes creating the at least one opening entirely within the tile grout.

In still other embodiments, creating the openings comprises locating the openings so that they overlap a ceramic tile of the plurality of ceramic tiles.

In additional embodiments, creating the openings includes penetrating the tile grout and the planar substrate.

In some embodiments, the method includes engaging a fan to heat the planar substrate and the plurality of tiles.

In other embodiments, the method includes heating the planar substrate and the plurality of ceramic tiles until the adhesive is fully cured.

In a third aspect, there is provided a method of constructing a tile bathroom that includes providing a first prefabricated wall including a plurality of ceramic tiles, wherein the first prefabricated wall includes a first opening. The method also includes providing a second prefabricated wall including a plurality of ceramic tiles, wherein the second prefabricated wall includes a second opening. In addition, the method includes providing a third prefabricated wall including a plurality of ceramic tiles, wherein the third prefabricated wall includes a third opening. The method may also include coupling the first prefabricated wall to a first wall of a building by placing a first fastening mechanism within the first opening. The method also includes coupling the second prefabricated wall to a second wall of a building by placing a second fastening mechanism within the second opening. In addition, the method includes coupling the third prefabricated wall to a third wall of a building by placing a third fastening mechanism within the third opening. The method also includes covering the first, second and third openings with an epoxy grout.

In some embodiments, the first, second and third prefabricated walls include a tile grout.

In other embodiments, a color of the tile grout substantially matches a color of the epoxy grout when the epoxy grout is cured.

In yet other embodiments, the first, second and third openings are located within the tile grout.

In still other embodiments, the method includes locating a prefabricated pan adjacent to the first, second and third prefabricated walls.

For a more complete understanding of the present invention, including additional features, objects and advantages thereof, reference is now made to the following detailed description taken in conjunction with the drawings, in which:

DETAILED DESCRIPTION

Figure 1:
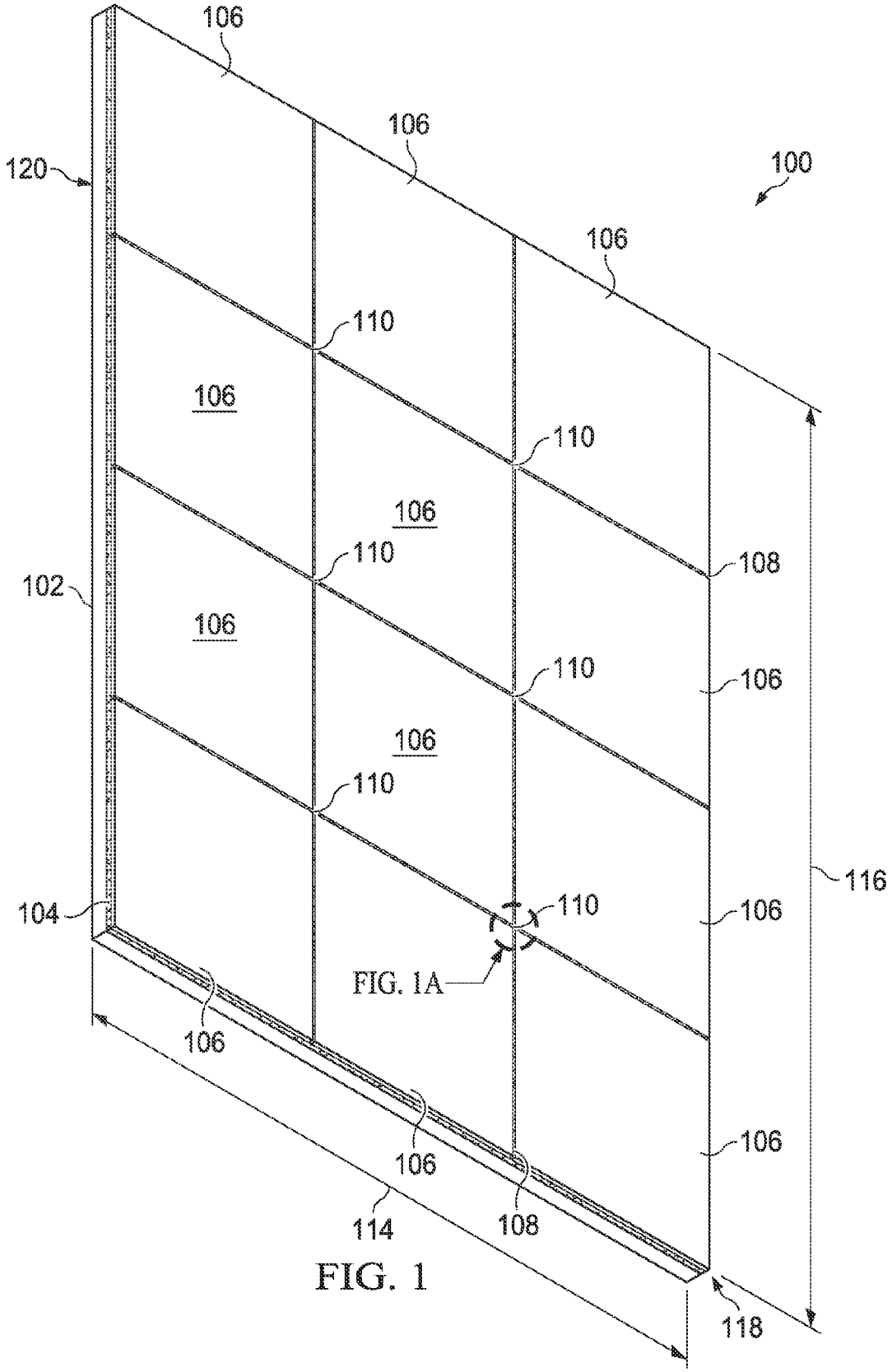
FIG. 1 is a perspective view of a prefabricated tile wall in accordance with this disclosure.

In the description which follows, like parts are marked throughout the specification and drawings with the same reference numerals. The drawings may not be to scale and certain features may be shown exaggerated in scale or in somewhat schematic form in the interest of clarity and conciseness.

FIG. 1 is a perspective view of an embodiment of a prefabricated tile wall 100 that can be used in the construction of a kitchen, bathroom, laundry room or other room in a building. As will be described in more detail below, the prefabricated wall 100 is at least partially prefabricated at a remote location to reduce the time, effort and skill required during final installation of the wall 100 at the building site. In addition, in some embodiments the prefabricated wall 100 is resistant to sagging or other distortion during transportation to the building site, thereby reducing defect rates compared with other building materials. The design of the prefabricated wall 100 also minimizes the steps required to install the wall 100 at the final construction location, thereby reducing incidents of damage to the tile during installation or incorrect assembly by workers. As such, the prefabricated wall 100 is ideal for use in mobile homes, speculation homes or other buildings to reduce the time and cost associated with final construction.

Referring again to FIG. 1, in some embodiments the prefabricated wall 100 includes a planar substrate 102, an adhesive 104, a plurality of ceramic tiles 106, tile grout 108, and one or more openings 110 located between the ceramic tiles 106. In some embodiments, the planar substrate 102 is a rigid material having a substantially flat front surface to which the tiles 106 are secured. In the embodiment illustrated in FIG. 1, the planar substrate 102 is rectangular in shape. However, in other embodiments the planar substrate 102 may be any suitable shape. In addition, the planar substrate 102 may be made of any suitable material. For example, in some embodiments the planar substrate 102 is rectangular in shape and is made of a water-proof or water-resistant material, such as a cement board material. In yet other embodiments, the planar substrate 102 is square in shape and is made of an underlayment material, such as underlayment material manufactured by James Hardie, Chicago, Ill. In other embodiments, the planar substrate 102 is made of fiber cement underlayment, magnesium oxide underlayment or any other underlayment approved for tile floor applications.

In some embodiments, the planar substrate 102 has a length 114 and height 116 that correspond to the length and height of the wall of the building that is to be covered by the prefabricated wall 100. In other embodiments, the planar substrate 102 has a length 114 and height 116 that correspond to the length and width of a shower area or bathtub area commonly found in bathrooms of newly constructed homes. In yet other embodiments, the planar substrate 102 may have any suitable size that is configured to suit the final use of the tile wall 100. In some embodiments, for example, the planar substrate 102 is about forty-eight inches by sixty inches.

The adhesive 104 is placed on the front face of the planar substrate 102 to couple the tiles 106 to the planar substrate 102. The adhesive 104 may be any suitable material for coupling ceramic tiles 106 to a planar substrate 102. For example, in some embodiments the adhesive 104 is a thinset mortar material or a rapid setting modified thinset, such as Quik Flex Accelerated Thin Set Mortar made by TEC located in Aurora, Ill. In some embodiments, a worker or machine spreads the adhesive 104 on the front surface of the planar substrate 102 and then places the ceramic tiles 106 on the adhesive 104 in the desired orientation. In some embodiments, for example, the ceramic tiles 106 are placed on the planar substrate 102 in a series of rows and columns, as illustrated in FIG. 1.

Any type, size and shape of ceramic tile 106 may be used in the prefabricated wall 100. For example, in some embodiments the ceramic tiles 106 are rectangular in shape and are approximately thirteen inches by thirteen inches. In other embodiments, the tiles are approximately twelve inches by twenty-four inches. In other embodiments, the ceramic tiles 106 are circular, rectangular, oblong, or other shapes.

In some embodiments, each tile 106 is spaced from the adjacent tiles 106 by one or more spacers (not illustrated in FIG. 1). When the spacers are removed, the area between adjacent tiles 106 is filled with tile grout 108. The tile grout 108 may be any suitable grout 108 known to those skilled in the art. In some embodiments, the tile grout 108 is a quick set grout such as Power Grout made by TEC located in Aurora, Ill. In some embodiments, a worker or machine places the tile grout 108 between the tiles 106 after the adhesive 104 has cured. In yet other embodiments, the worker or machine places the tile grout 108 between the tiles 106 before the adhesive 104 has secured. The method of curing the adhesive 104 and the tile grout 108 is discussed in more detail below. In some embodiments, the grout 108 is placed between the tiles 106 to cover the portions of the top surface of the planar substrate 102 that are located between the tiles 106.

Figure 1A:
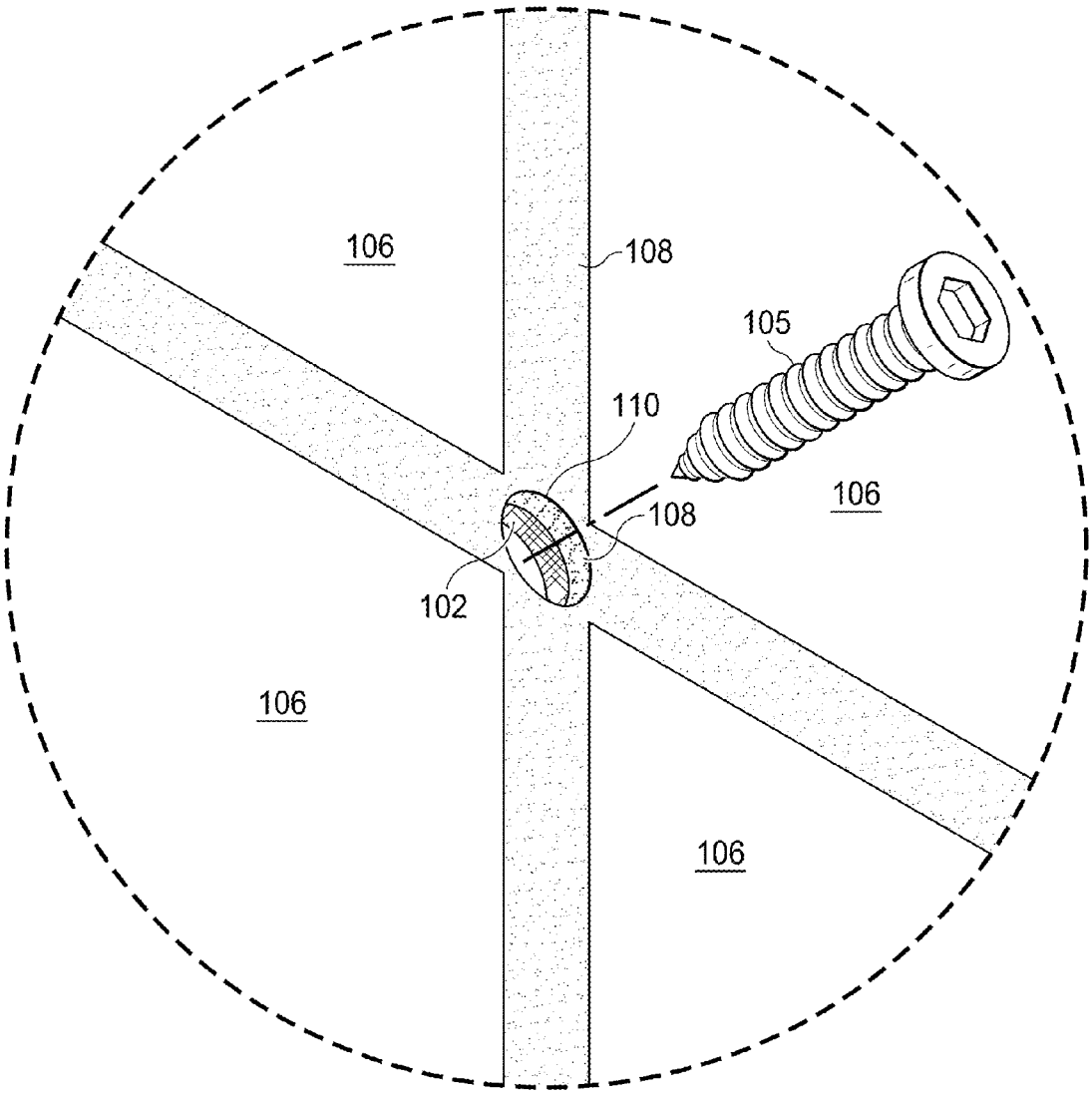
FIG. 1A is a close-up view of the prefabricated tile wall of FIG. 1.

In some embodiments, the prefabricated wall 100 includes one or more openings 110 to facilitate attachment of the prefabricated wall 100 to the wall of a building. In some embodiments, the openings 110 are located in the prefabricated wall 100 between the tiles 106. In some embodiments, for example, the openings 110 are located at least partially within the tile grout 108 and are situated in the tile grout 108 near the corners 118 of the tiles 106, as illustrated in FIG. 1A. In some embodiments, the openings 110 are located entirely within the tile grout 108, while in other embodiments the openings 110 are located at least partially within the tile grout 108 and at least partially overlapping one or more of the tiles 106. In some embodiments, the openings 110 penetrate the entire depth of the tile grout 108 and the planar substrate 102 to provide an aperture that extends entirely through the prefabricated wall 100. In some embodiments, the openings 110 are formed by drilling an aperture completely through the prefabricated wall 100, while in other embodiments any suitable method may be used to form the openings 110.

While six openings 110 are shown in the embodiment illustrated in FIG. 1, the prefabricated wall 100 may include any number of openings 110 in other embodiments. In addition, while the openings 110 in the embodiment illustrated in FIG. 1 are located near the corners 118 of the tiles, the openings 110 can be located at any position in the tile grout 108.

Figure 2:
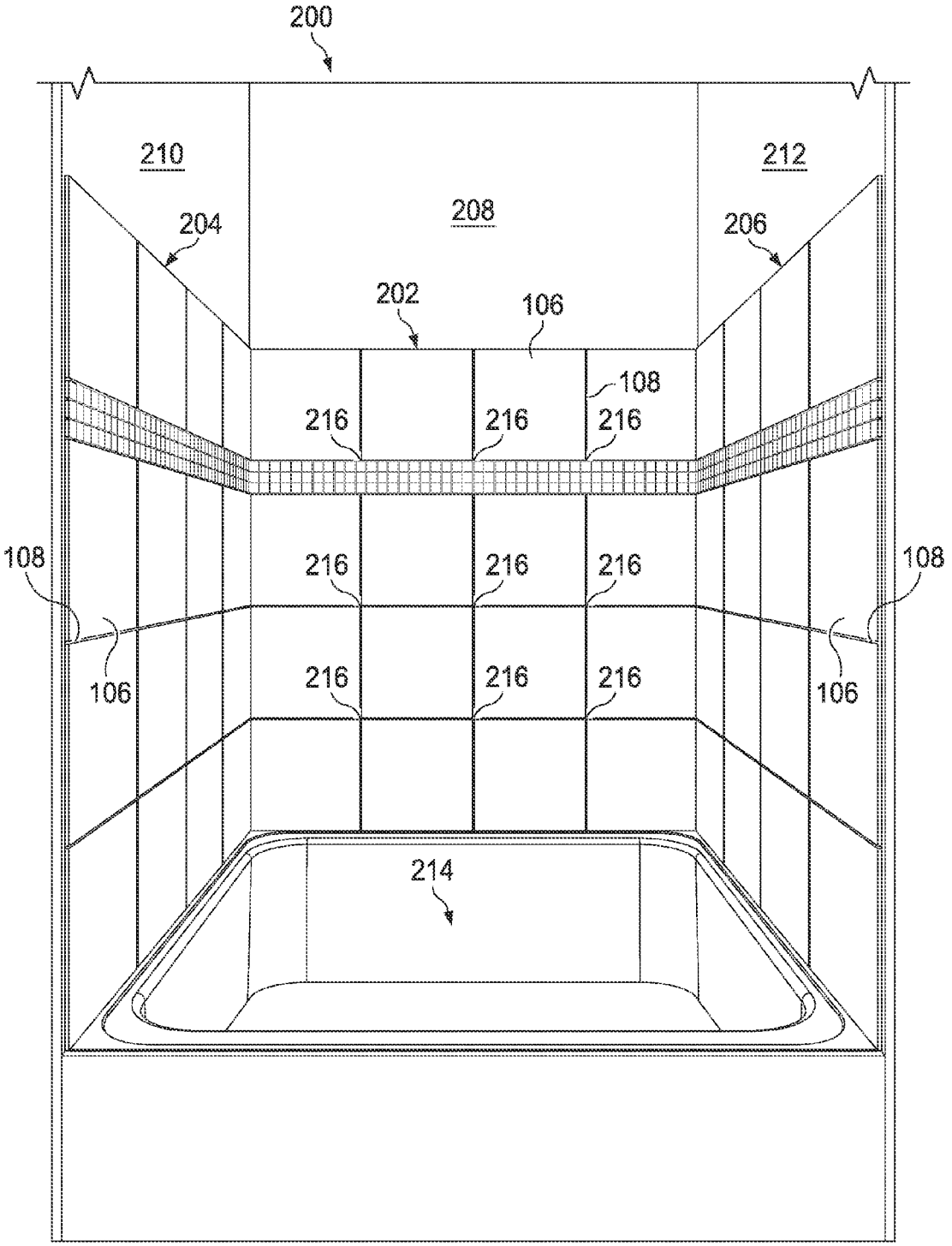
FIG. 2 is a perspective view of an embodiment of a bathroom including at least one prefabricated wall in accordance with this disclosure.

As discussed above, the prefabricated tile wall 100 may form part of a bathroom, laundry room, kitchen or other similar room or feature in a building. FIG. 2 illustrates an example embodiment of a bathtub 200 that includes three prefabricated tile walls: a first prefabricated wall 202, a second prefabricated wall 204, and a third prefabricated wall 206. As illustrated in the embodiment of FIG. 2, the first, second, and third prefabricated walls 202, 204 and 206 can be coupled to first, second, and third walls 208, 210, and 212 of a building, respectively, by placing fastening mechanisms 105 within the openings 110 and securing the fastening mechanisms 105 to the respective wall 208, 210 or 212, as will be discussed in more detail below.

As discussed above, the prefabricated walls 202, 204 and 206 may be any suitable size and shape. In the embodiment illustrated in FIG. 2, for example, the walls 202, 204 and 206 are rectangular in shape and the first wall 202 is larger than the second and third walls 204 and 206. In other embodiments, the walls 202, 204 and 206 may the same size and shape or may each be different sizes and shapes. In some embodiments, the first, second and third walls 202, 204 and 206 are equal in size (i.e., substantially equal in height and width) while in other embodiments the walls 202, 204 and 206 are different sizes (i.e., different in height and width). In the embodiment illustrated in FIG. 2, the first, second and third prefabricated walls 202, 204 and 206 each have substantially the same height so that top edges of the first, second and third walls 202, 204 and 206 are aligned when the prefabricated walls 202, 204 and 206 are installed. In some embodiments, the size of the walls 202, 204 and 206 corresponds to the size of the feature that is enclosed by the walls, such as the bathtub pan 214 illustrated in FIG. 2.

In some embodiments, the prefabricated walls 202, 204 and 206 are positioned directly above a prefabricated pan 214, or other prefabricated element, to form a substantially water-resistant area, such as a shower or bathtub. In some embodiments, a sealant or other material seals the walls 202, 204 and 206 to the additional element. In some embodiments, the pan 214 or other element includes a recess to hold water for use as a bathtub or shower pan.

While three walls 202, 204 and 206 are illustrated in the embodiment of FIG. 2, a tile shower or bathtub may include more or less than three prefabricated walls 202, 204 and 206. In addition, the walls 202, 204 and 206 may be oriented in any suitable configuration to serve the purpose of the room. For example, in a kitchen the prefabricated wall or walls may be secured to a wall of the building near the sink to serve as a backsplash for the sink.

In some embodiments, the tile bathroom or other room also includes additional tiles, such as one or more bullnose titles (not illustrated in FIG. 2), that are secured to the walls 208, 210 or 212 of the room using traditional tiling methods. One of skill in the art will recognize that the prefabricated walls 202, 204 and 206 can be used with any suitable combination with other prefabricated and non-prefabricated elements.

Figure 3:
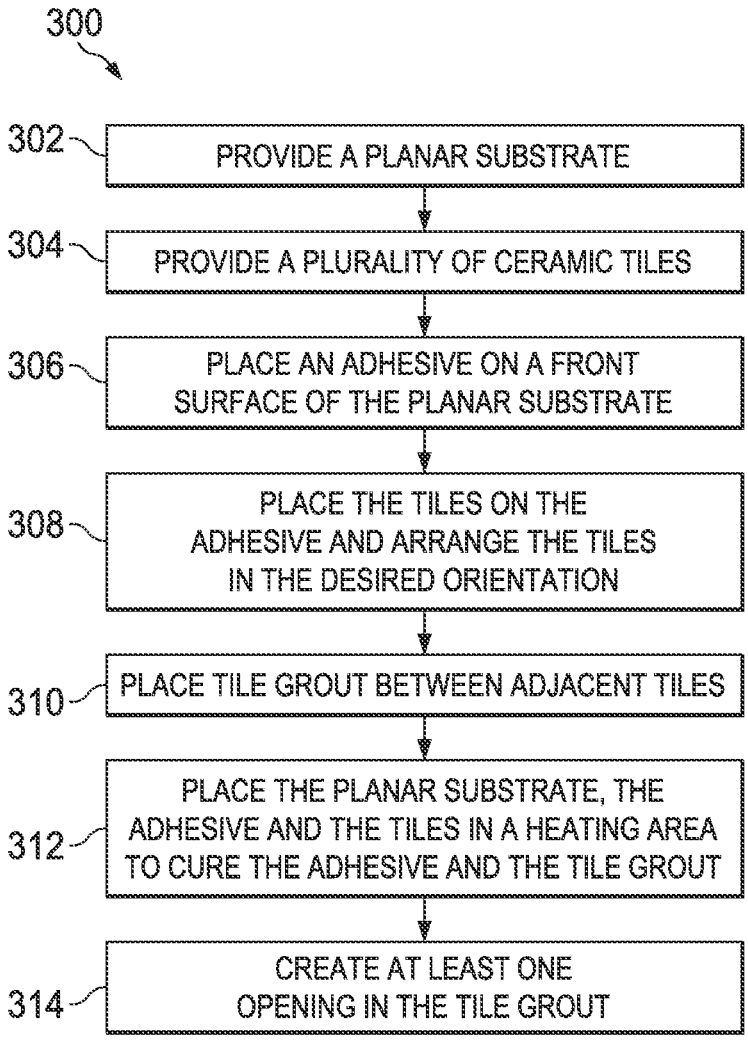
FIG. 3 is a schematic diagram illustrating a method of constructing a tile wall for a bathroom or other part of a building in accordance with this disclosure.

FIG. 3 is a schematic diagram illustrating a method 300 of constructing a prefabricated tile wall 100 for a bathroom. In some embodiments, the method 300 begins and a planar substrate 102 is provided, as illustrated at block 302. In some embodiments, a plurality of ceramic tiles 106 are also provided, as illustrated at block 304. In some embodiments, a combined surface area of the plurality of tiles 106 is less than the total surface area of the planar substrate 102 so that the plurality of tiles 106 can be arranged on the surface of the planar substrate 102 and so that a predetermined spacing can be maintained between adjacent tiles 106.

In some embodiments, an adhesive 104, such as a thinset mortar, is placed on a front surface of the planar substrate 102, as illustrated at block 306. In some embodiments, the adhesive 104 is placed over substantially all of the surface of the planar substrate 102 and is applied using a tile trowel or other tool that creates a series of ridges and valleys in the adhesive 104 to better adhere the adhesive 104 to a back surface of the ceramic tiles 106.

The plurality of tiles 106 are then placed on the adhesive 104 and arranged in the desired orientation, at illustrated at block 308. In some embodiments, for example the tiles 106 are arranged in a series of rows and columns to cover a majority of the front surface of the planar substrate 102. As described above, a plurality of spacers can be placed between the tiles 106 to maintain the appropriate spacing between adjacent tiles 106.

In some embodiments, a tile grout 108 is then placed between adjacent tiles 106, as illustrated at block 310, to fill the space between the adjacent tiles 106. In some embodiments, the adhesive 104 is allowed to cure or partially cure before the tile grout 108 is placed between the tiles 106, while in other embodiments the adhesive 104 is not allowed to cure before the tile grout 108 is placed between the tiles 106. In some embodiments, the planar substrate 102, the adhesive 104, and the tiles 106 are placed in a heating area to cure the adhesive 104, as illustrated at block 312. In some embodiments, for example, the planar substrate 102 is placed on a conveyor and conveyed into the heating area. In some embodiments, the heating area is heated by blowing heated air into the heating area using one or more fans.

The heating area may be heated to any suitable temperature. In some embodiments, the temperature in the heating area varies depending on the humidity and external temperature of the facility within which the heating area is located. In some embodiments, for example, the heating area is maintained at a temperature between about seventy-five and about ninety-two degrees Fahrenheit. In some embodiments, the planar substrate 102, the adhesive 104 and the tiles 106 remain in the heating area for between about forty-five and ninety minutes. In some embodiments, the planar substrate 102, the adhesive 104, and the tiles 106 remain the heating area until the adhesive 104 has at least partially cured. In other embodiments, the planar substrate 102, the adhesive 104, and the tiles 106 remain in the heating area until the adhesive 104 has completely cured. In some embodiments, the tile grout 108 is placed between the tiles 106 prior to placing the prefabricated door 100 into the heating area. As such, in some embodiments the tile grout 108 is also fully or partially cured in the heating area.

In some embodiments, at least one opening 110 is then created in the tile grout 108, as illustrated at block 314. In some embodiments, for example, the openings 110 area created by drilling a hole in the tile grout 108 between the tiles 106. In some embodiments, multiple openings 110 are created in a prefabricated wall 100. For example, in some embodiments the wall 100 includes an opening 110 near the corner 118 of each tile 106. In other embodiments, the wall 100 includes openings 110 near the corner 118 of each tile 106 of the wall 100 except the exterior corners 118 (i.e., the corners 118 directly adjacent to the outer edge 120 of the planar substrate 102). In yet other embodiments, the openings 110 are positioned on the prefabricated wall 100 so that the openings 110 align with the location of securing points in the wall 208, 210 or 212 of the building, such as the location of furring strips on the building wall 208, 210 or 212.

As described above, in some embodiments the openings 110 extend through the tile grout 108 and through the planar substrate 102 so that the openings 110 provide apertures that extend completely through the prefabricated wall.

Figure 4:
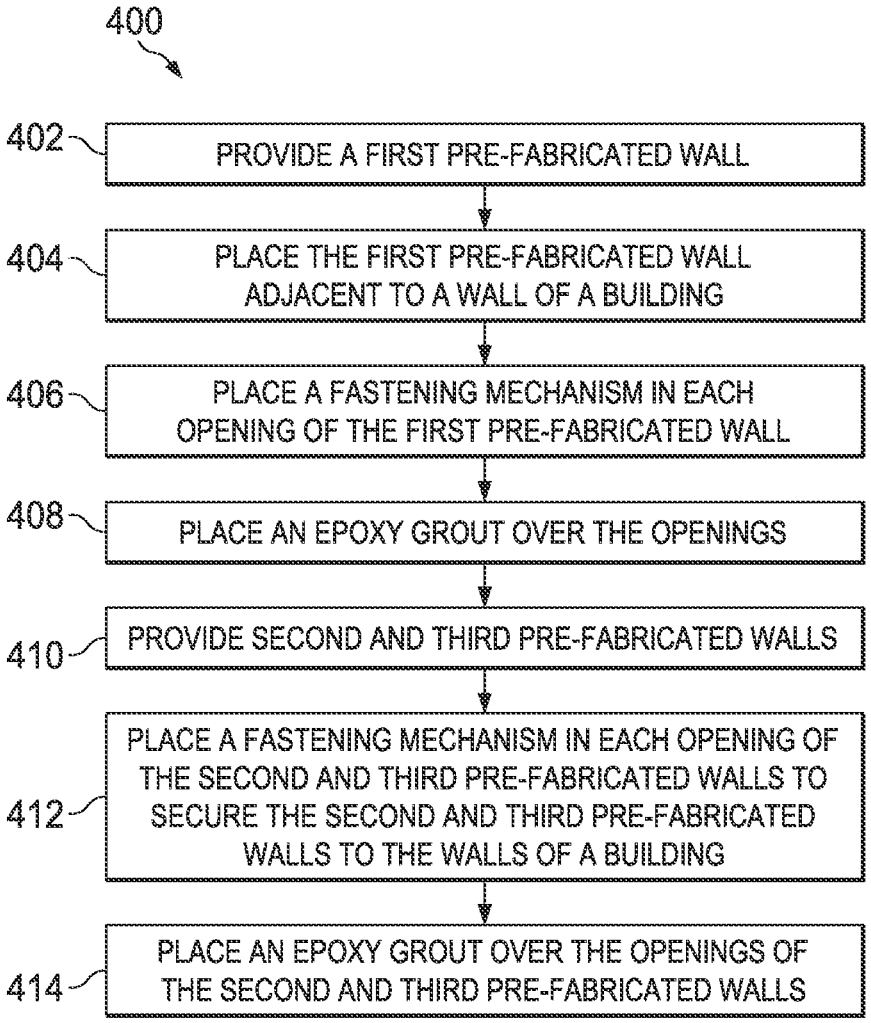
FIG. 4 is a schematic diagram illustrating a method of constructing a tile bathroom in accordance with this disclosure.

FIG. 4 is a schematic diagram illustrating a method 400 of constructing a tile bathroom using one or more prefabricated walls 100. In some embodiments, the method 400 begins and a prefabricated wall 100 is provided, as illustrated at block 402. In some embodiments, the prefabricated wall 100 includes a planar substrate 102 and a plurality of ceramic tiles 106 that are secured to the planar substrate 102. In some embodiments, the prefabricated wall 100 includes at least one opening 110 positioned between the plurality of tiles 106. As described above, in some embodiments the openings 110 are located in the tile grout 108 that is positioned between adjacent tiles 106 on the prefabricated wall 100.

To secure the prefabricated wall 100 to the wall 208, 210 or 212 of a building, the prefabricated wall 100 is first placed adjacent to the wall 208, 210 or 212 of a building, as illustrated at block 404. A fastening mechanism 105, such as a screw, is then placed in each opening 110 and is secured to the wall 208, 210 or 212 of the building thereby securing the prefabricated wall 100 to the wall 208, 210 or 212 of the building, as illustrated at block 406. Some embodiments, the fastening mechanism 105 is a screw, nail, or other connector capable of securing the prefabricated wall 100 to the wall 208, 210 or 212 of the building. In some embodiments, the method 400 also includes placing adhesive 104 between prefabricated wall 100 and the wall 208, 210 or 212 of the building.

Once the prefabricated wall has been secured to the wall 208, 210 or 212 of the building, an epoxy grout 216 is placed over the openings 110, as illustrated at block 408. In some embodiments, a color of the tile grout 108 matches the color of the epoxy grout 216 so that, when the epoxy grout 216 and the tile grout 108 have cured, the epoxy grout 216 is substantially indistinguishable from the tile grout 108. As such, the end user is unable to observe the openings 110 once the wall 100 has been fully installed. As such, the prefabricated wall 100 is substantially indistinguishable from a traditional, non-prefabricated wall once the prefabricated wall 100 has been installed.

In some embodiments, the method 400 of constructing a tile bathroom also includes providing second and third prefabricated walls 204 and 206, as illustrated at block 410, and then securing the second and third prefabricated walls 204 and 206 to second and third walls 210 and 212 of the building by placing a fastening mechanism 105 in each opening 110 of the second and third prefabricated walls 204 and 206, as illustrated at block 412. In some embodiments, an epoxy grout 216 is placed over the openings 110 of the second and third walls 204 and 206 so that when the epoxy grout 216 has cured, the openings 110 are substantially undetectable by a user.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "outer" and "inner," "upper" and "lower," "first" and "second," "internal" and "external," "above" and "below" and the like are used as words of convenience to provide reference points and are not to be construed as limiting terms.

In addition, the foregoing describes only some embodiments of the invention(s), and alterations, modifications, additions and/or changes can be made thereto without departing from the scope and spirit of the disclosed embodiments, the embodiments being illustrative and not restrictive.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Although specific embodiments have been described in detail, those skilled in the art will also recognize that various substitutions and modifications may be made without departing from the scope and spirit of the appended claims.

What is claimed is:

1. A method of constructing a tile bathroom, the method comprising:

providing a prefabricated wall, wherein the prefabricated wall includes a planar substrate and a plurality of ceramic tiles secured to the planar substrate, wherein the prefabricated wall includes at least one opening positioned between the plurality of tiles;

placing the planar substrate adjacent to a wall of a building;

placing a fastening mechanism in the at least one opening to secure the prefabricated wall to the wall of the building; and covering the fastening mechanism and the at least one opening with an epoxy grout.

2. The method of claim 1, wherein the prefabricated wall includes tile grout between the plurality of tiles.

3. The method of claim 2, wherein the tile grout has a first color and the epoxy grout has a second color, wherein the first color matches the second color.

4. The method of claim 2, wherein the at least one opening is located at least partially within the tile grout.

5. The method of claim 2, wherein providing a prefabricated wall comprises heating the planar substrate, the plurality of tiles and the tile grout to cure the tile grout.

6. The method of claim 1, wherein placing a fastening mechanism in the at least one opening to secure the prefabricated wall to the wall of the building comprises screwing the fastening mechanism into the wall of the building.

7. The method of claim 1, further comprising placing an adhesive between the prefabricated wall to the wall of the building.

8. The method of claim 1, wherein the prefabricated wall includes tile grout disposed between the plurality of tiles and the tile grout is rapid set grout.

9. A method of constructing a tile wall for a bathroom, the method comprising:

providing a planar substrate;

providing a plurality of ceramic tiles;

placing an adhesive between the planar substrate and the plurality of ceramic tiles;

placing a tile grout between the plurality of ceramic tiles;

heating the planar substrate and the plurality of ceramic tiles until the adhesive is at least partially cured; and creating at least one opening in the tile grout.

10. The method of claim 9, further comprising creating a plurality of openings located at least partially within the tile grout.

11. The method of claim 9, wherein creating the at least one opening comprises creating the at least one opening entirely within the tile grout.

12. The method of claim 9, wherein creating the at least one opening comprises locating the at least one opening so that the at least one opening overlaps a ceramic tile of the plurality of ceramic tiles.

13. The method of claim 9, wherein creating the at least one opening comprises penetrating the tile grout and the planar substrate.

14. The method of claim 9, further comprising engaging a fan to heat the planar substrate and the plurality of tiles.

15. The method of claim 9, further comprising heating the planar substrate and the plurality of ceramic tiles until the adhesive is fully cured.

16. A method of constructing a tile bathroom, the method comprising:

providing a first prefabricated wall including a plurality of ceramic tiles, wherein the first prefabricated wall includes a first opening;

providing a second prefabricated wall including a plurality of ceramic tiles, wherein the second prefabricated wall includes a second opening;

providing a third prefabricated wall including a plurality of ceramic tiles, wherein the third prefabricated wall includes a third opening;

coupling the first prefabricated wall to a first wall of a building by placing a first fastening mechanism within the first opening;

coupling the second prefabricated wall to a second wall of a building by placing a second fastening mechanism within the second opening;

coupling the third prefabricated wall to a third wall of a building by placing a third fastening mechanism within the third opening; and covering the first, second and third openings with an epoxy grout.

17. The method of claim 16, wherein the first, second and third prefabricated walls comprise a tile grout.

18. The method of claim 17, wherein a color of the tile grout substantially matches a color of the epoxy grout when the epoxy grout is cured.

19. The method of claim 17, wherein the first, second and third openings are located within the tile grout.

20. The method of claim 16, further comprising locating a prefabricated pan adjacent to the first, second and third prefabricated walls.

* * * * *